United States Patent [19]

Mariol

[11] Patent Number: 4,515,359

[45] Date of Patent: May 7, 1985

[54] TOY KITCHEN PLAY CENTER

[76] Inventor: James F. Mariol, 481 Deanview Dr., Cincinnati, Ohio 45224

[21] Appl. No.: 459,207

[22] Filed: Jan. 19, 1983

[51] Int. Cl.[3] ..... A63H 33/30

[52] U.S. Cl. ..... 272/1 R; 108/33; 108/50; 312/204; 312/282; 446/141; 446/481

[58] Field of Search ..... 272/1 R; 46/14, 15, 46/33; 434/382, 383, 432; 312/204, 236, 237, 228, 282; 108/25, 33, 50, 78, 134; 446/141, 479, 481, 482

[56] References Cited

U.S. PATENT DOCUMENTS

| | | | |
|---|---|---|---|
| 498,974 | 6/1893 | Harkinson | 312/282 |
| 1,696,145 | 12/1928 | Wagoner | 108/134 X |
| 1,862,654 | 6/1932 | Booth | 312/228 |
| 2,539,613 | 1/1951 | Earle | 312/236 X |
| 2,944,862 | 7/1960 | Heil | 312/237 |
| 3,133,376 | 5/1964 | Orenstein | 46/14 |
| 3,289,664 | 12/1966 | Hewitt | 312/236 X |
| 3,318,612 | 5/1967 | Kuhn | 46/15 X |
| 3,591,974 | 7/1971 | Thornell | 46/33 |
| 4,082,391 | 4/1978 | Turner | 312/237 X |
| 4,135,315 | 1/1979 | McKee | 46/15 X |
| 4,221,441 | 9/1980 | Bain | 312/228 |
| 4,332,101 | 6/1982 | Tomita | 46/14 X |
| 4,333,258 | 6/1982 | McCaslin | 46/14 |

FOREIGN PATENT DOCUMENTS

| | | | |
|---|---|---|---|
| 2290869 | 6/1976 | France | 312/237 |

*Primary Examiner*—Richard T. Stouffer

*Attorney, Agent, or Firm*—Wood, Herron & Evans

[57] ABSTRACT

A toy kitchen play center device is disclosed which includes, in a unitary structure, a simulated stove, cooking range, kitchen sink, cabinet/refrigerator, telephone, kitchen canopy and ventilation unit, and further includes a folding table which is pivotably connected to one side of the stove and pivotable between an upright and raised position into a folded position parallel to the side of the stove. The kitchen play center has an upright wall panel structure which serves to support the canopy at one end, the canopy being carried at the other end by a vertical upright such that the canopy extends over the stove top. The toy kitchen play center is particularly designed to be compact in form to facilitate storage and shipping thereof. To this end, the entire kitchen play center can be packed within a generally rectangular container of minimum volume, having an interior bottom which is substantially of the same area and shape as that of the rectangular perimeter defined by the stove top and which has a vertical height substantially the same as the vertical height of the stove with the canopy stacked thereon.

4 Claims, 7 Drawing Figures

TOY KITCHEN PLAY CENTER

FIELD OF THE INVENTION

This invention relates generally to toys and more particularly to a miniature child size toy kitchen.

BACKGROUND OF THE INVENTION

Toy kitchen structures have been designed in the past with the various components making up the toy kitchen embodied in a nonunitary arrangement. That is, such elements as a stove, kitchen sink, kitchen table etc. are each included in the toy kitchen as separate and independently standing structures or modules. A number of such kitchen elements consequently occupy a relatively large area. Further, since the plural elements making up such a toy kitchen are ordinarily irregular in shape and size, large and bulky packaging is often required for shipping and storage of an entire kitchen play set. Actual packing of the individual components into a single container also requires some skill, and often the use of cushioning materials between the various elements to prevent damage during shipping.

SUMMARY OF THE INVENTION

It is a general object of the present invention to provide a child-size toy kitchen that is relatively realistic, attractive, and entertaining for the child user.

A more specific object of the invention is to provide a kitchen play center including a simulated stove, range, kitchen sink etc. which is compactly arranged in a unitary structure.

Yet another object of the present invention is to provide a unitary structure for a toy kitchen play center which facilitates the packing, storage and shipping of the structure within a rectangular shipping container which is of minimum volume.

These, as well as other objects have been accomplished in the present invention in a toy kitchen play center device which embodies in a unitary structure a simulated stove, cooking range, kitchen sink, cabinet/-refrigerator, telephone, canopy and and ventilation unit, and which further includes a folding table, and in a preferred embodiment, at least one child size chair. The simulated stove serves as a base for the kitchen play center and has a top, front and back, bottom and sides. A simulated oven having an internal cavity and a door for accessing the cavity forms the front of the stove. A pair of swinging doors on the back of the stove serve to access another internal cavity which can be adapted as a cabinet or simulated refrigerator. The simulated cooking range and kitchen sink are located on adjacent portions of the top of the stove, advantageously in back to back relation. The kitchen play center device further includes an upright wall panel structure located on yet another portion of the top of the stove and adjacent one of the sides, which has the toy telephone mounted thereon. The kitchen canopy, with the simulated ventilation unit formed thereon, extends over the stove top, being carried at one end by the wall panel structure and the other end by a vertical upright extending from the stove top surface.

The folding table is pivotably connected along one side of the stove, and is pivotable between an upright and raised position wherein the table extends substantially perpendicular to the stove side to a folded position wherein the table is substantially parallel with the same stove side. The table is supported by a vertically extending support member which is pivotably connected to the same stove side, and which swings between a table support position wherein the support extends generally perpendicular to the stove side to a closed or folded position wherein the support is swung against the side of the stove.

The kitchen play center defines a generally rectangular solid shape with the table folded and the canopy and its supports detached. The canopy itself is not wider than the stove top's widest dimension and can be conveniently stacked flat thereon for packaging. The wall support and vertical upright for the canopy conveniently fit within the stove's cavities. The entire kitchen play center can thus be packed within a generally rectangular container which has a horizontal cross-section substantially of the same area and shape as that of the rectangular perimeter defined by the stove top, and which has a vertical height substantially the same as the vertical height of the stove with the canopy set flat thereon.

The kitchen play center of this invention is therefore compactly arranged in a unitary structure which can be easily stored when not in use. The formation of the play center in such a unitary structure further facilitates the packing of the toy in a container of minimized volume, which further reduces the storage volume required where a number of packaged play centers are warehoused or stocked for inventory.

The foregoing objectives, features and advantages of the present invention will be more readily understood upon consideration of the following detailed description of the invention taken in conjunction with accmpanying drawings, in which:

DETAILED DESCRIPTION OF THE DRAWINGS

DETAILED DESCRIPTION OF A PREFERRED EMBODIMENT OF THE INVENTION

Figure 1:
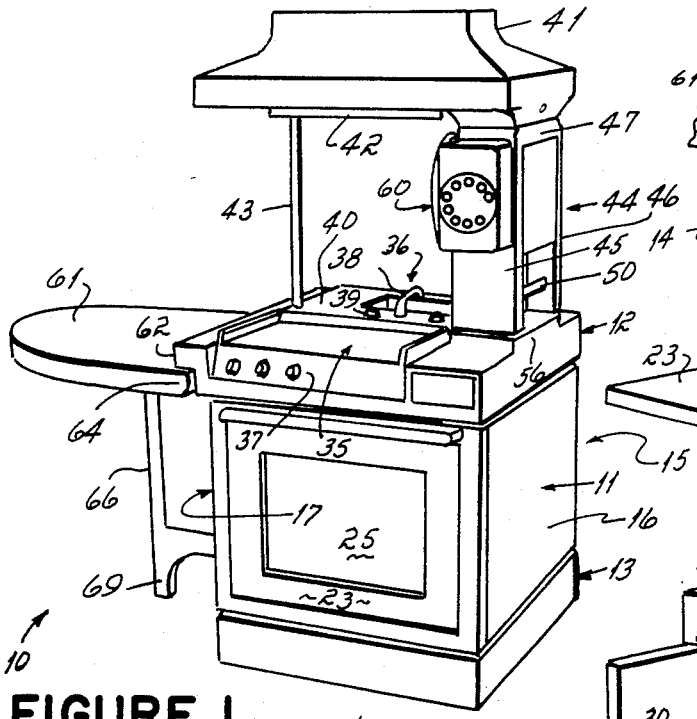
FIG. 1 is a front perspective view of a kitchen play center made in accordance with the principles of this invention with the folding table open.

Referring now to FIG. 1, the toy kitchen play center device of this invention is generally designated by the reference numeral 10. The kitchen play center 10 has a simulated stove body 11 which serves as the base for the entire kitchen play center. The stove 11 is in the general shape of a cube, having a top 12, bottom 13, front 14, back 15, and lateral sides 16 and 17.

Figure 2:
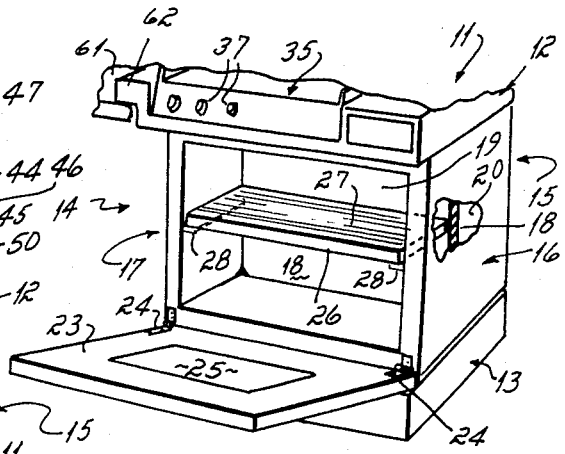
FIG. 2 is a fragmentary view similar to FIG. 1 with the oven door open, a stove side being partly broken away for detail.
Figure 3:
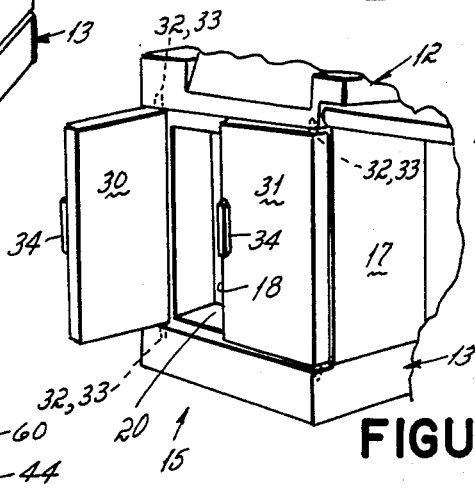
FIG. 3 is a fragmentary rear perspective view of the kitchen play center with one of the cabinet/refrigerator doors open.

With specific reference to FIGS. 2 and 3, the stove defines a hollow box in form. The interior hollow area or cavity is divided approximately in two by a wall divider 18 to thereby define front and back cavities 19 and 20, respectively. The divider 18 may be formed out of cardboard or paperboard, and may additionally be provided with a drawing or the like of food, condiments, etc. representative of what may be contained in either such cavity.

In this embodiment, the front cavity 19 is adapted to simulate an oven. The oven is provided with an oven door 23 which is movable between open and closed positions. The door is held in place in a conventional manner, such as through the use of simple hinges 24. The door may additionally be provided with a pane of a transparent or semi-transparent plastic 25 to permit viewing of the oven interior with the door closed. An oven rack 26 is also included in this embodiment. The rack 26 herein is formed out of a generally planar sheet of material, such as plastic, with corrugations 27 provided thereon. The rack 26 is supported in position within the oven on horizontally extending flanges 28 located on either side of the cavity 19, such that the rack 26 simply rests upon the upper surface of the flanges, and is therefore easily removed.

The back cavity 20 of the stove 10 is made accessible through matching cabinet doors 30 and 31. Handles 34 are additionally provided on each door. It will be noted that the doors are advantageously mounted so as to be approximately flush with the upper and lower side edges of the top 12 and bottom 13 of stove 10. To this end, the doors 30 and 31 are slightly inset. The doors 30 and 31 are mounted in a conventional manner, such as through the use of upper and lower pegs 32 received within sockets 33. The back cavity 20 serves as a storage area, such as a cabinet, or may be adapted to simulate a refrigerator. To this end, the figures or drawings on the back portion of the wall divider 18 may be dry goods or the like for a cabinet, or alternatively, goods which would ordinarily be found in a refrigerator.

Figure 4:
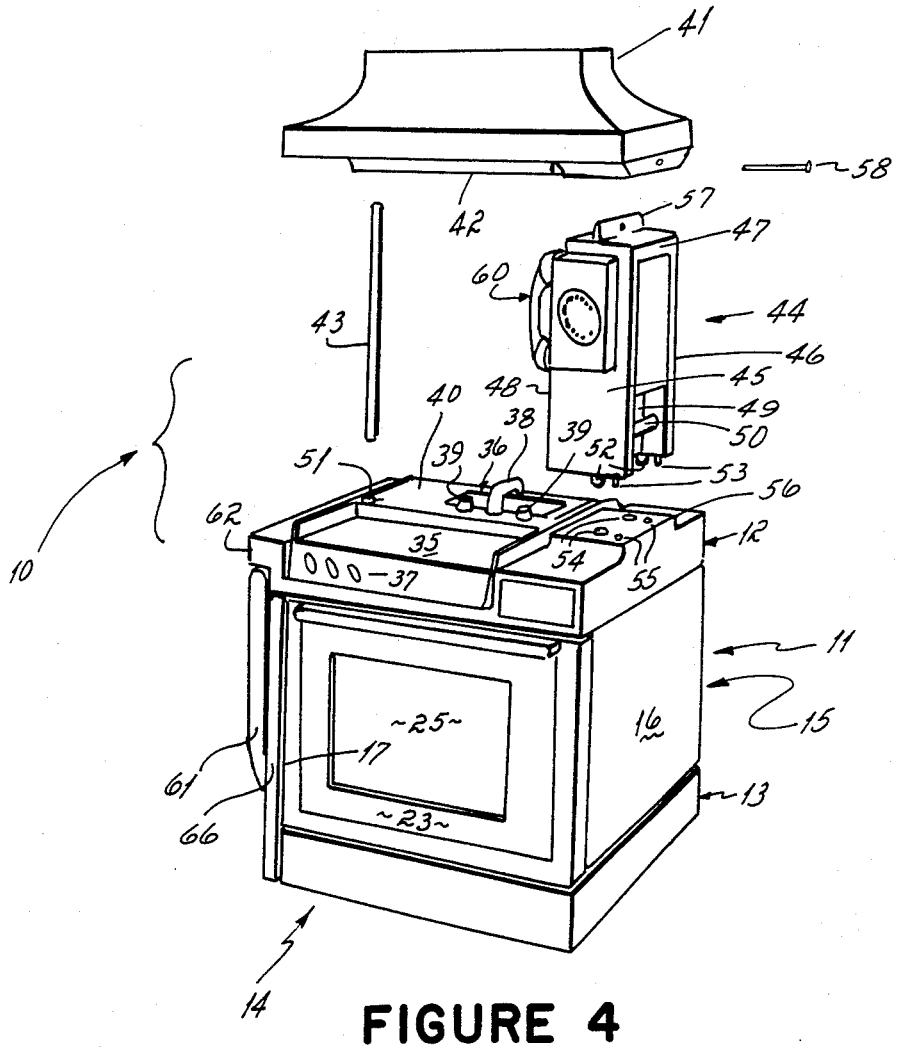
FIG. 4 is a front exploded perspective view of the kitchen play center.

Referring now to FIGS. 1 and 4, the kitchen play center 10 further includes a simulated cooking range 35 and a simulated kitchen sink 36 which are formed integral with the top 12 of the stove 10. In this embodiment, the range 35 and sink 36 are advantageously formed in back to back relationship.

The range has simulated burner controls 37. The sink includes toy plumbing fixtures in the form of a faucet 38 and faucet controls 39, and is additionally provided with a small work area 40 along one side of the sink. In this embodiment of the invention, the sink is actually capable of holding water, and includes a drain and drain plug (not shown) for draining out such water into the rear cavity 20. A bucket or the like would be used to collect the water so drained.

A canopy 41 extends over the majority of the stove top 12, and includes a simulated air ventilator 42 which is formed integral with the bottom interior of the canopy 41. The canopy is so sized that its lengthwise dimension $L_c$ (FIG. 5) is no wider than the same lengthwise dimension of the stove top $L_s$. As will be explained in more detail hereinafter, this facilitates the packaging of the toy kitchen play center 10, which is a significant advantage of this invention.

The canopy 41 is supported at opposite ends by a support rod 43 and an upright wall panel structure 44. In this embodiment of the invention, the wall panel structure 44 has opposed vertically extending sides 45 and 46, top 47, and may additionally include an interior facing side 48, as well as an indented outwardly facing side 49. A towel rack 50 is advantageously provided extending between the side walls 45 and 46 in the indented portion of the wall panel structure 44. A simulated telephone 60 is formed integral with or mounted on one side of the upright wall panel structure 44.

The canopy 41 and its supports are the only elements of the kitchen play center 10 which are not provided to the purchaser/user assembled to the stove base. For purposes of packaging, it should be noted that the wall panel structure 44 and the support rod 43 conveniently fit within the stove cavities. Erection of the canopy and the wall panel structure 44 is nevertheless simply and quickly effected. The support rod 43 fits within a preformed hole or detent 51 in the stove top 12 and is received in a like hole in the bottom of the canopy 41. Each of the wall panel structure sides 45 and 46 are provided in this embodiment with knob and push fasteners 52 and 53, respectively, which are received in preformed holes 54, 55, respectively, such that the wall panel structure 44 snugly seats on the top of the stove. A preformed seating mount 56 to receive the bottom of the wall panel structure 44 can be additionally provided, as here.

With the wall panel structure 44 in position on the stove top, the canopy 41 is mounted thereon and fixed into position by means of a vertical flange 57 formed along the top 47 of the wall panel structure 44 which is received in a correspondingly shaped hole or furrow (not shown) in the canopy bottom. Additional fixation for the canopy 41 is provided through the use of a bolt 58 which extends through preformed holes formed in the canopy side and the flange 57. A sturdy support for the canopy 41 is thus provided.

Figure 5:
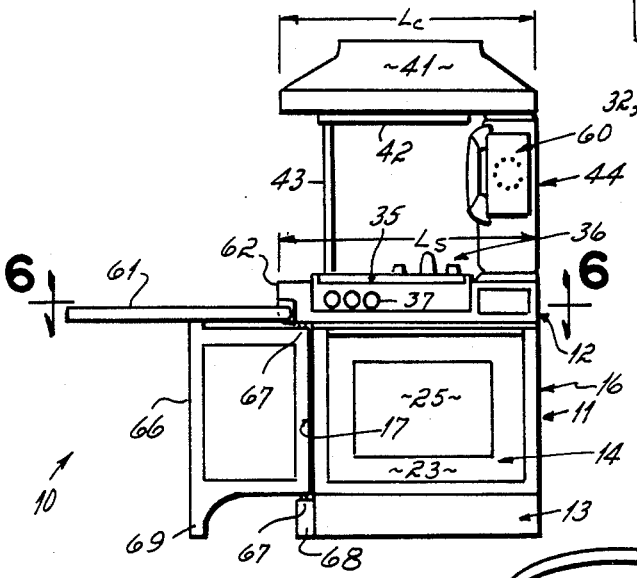
FIG. 5 is a front elevational view of the kitchen play center.
Figure 6:
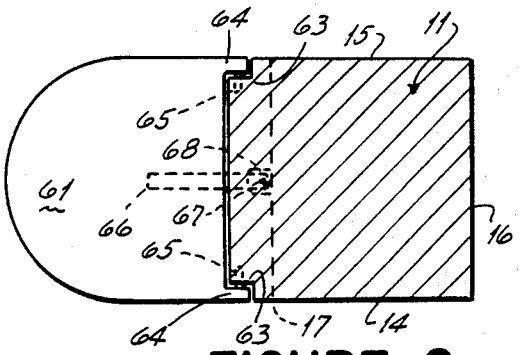
FIG. 6 is a cross-sectional view taken along line 6—6 of FIG. 5.

A folding table 61 is pivotably mounted along side 17 of the stove 11. With reference to FIGS. 5 and 6, the stove top 12 has a slight outward extension or overhang 62 along side 17 of the stove. Indentations or cutaway portions 63 are formed on the front and rear ends of the overhang 62 in which are received stubs 64 formed on the table 61. Each of the stubs 64 has a protuberance 65 which is inwardly directed and normal to the respective stub. The protuberance 65 is received within a predrilled hole in the indented portions 63 to thereby provide vertical swinging movement for the folding table 61.

The table 61 is maintained in an open or upright position through the use of a swinging table support 66. The table support is mounted for swinging movement through the use of upper and lower pins or protuberances 67 which are received in complimentary holes or detents formed in the bottom of the overhang portion 62 and the top of a lug 68 along the bottom side 17 of the stove. The table support 66 has a ground engaging leg 69 for additional support of the table 61. The table support 66 is so sized that when it is pivoted into facial engagement with the side 17 of the stove, it does not extend beyond the perimeter of the stove body (FIG. 5). To this end, the table support 66 is advantageously mounted approximately along the vertical midline to the side 17, and can be folded against either the front or back half of the side. With the table support 66 so folded against the side, the table 61 is folded downwardly where it hangs flush against the folded table support 66. It will be noted that the table 61 when folded in the closed position fits within the dimension $L_s$ of the stove.

Figure 7:
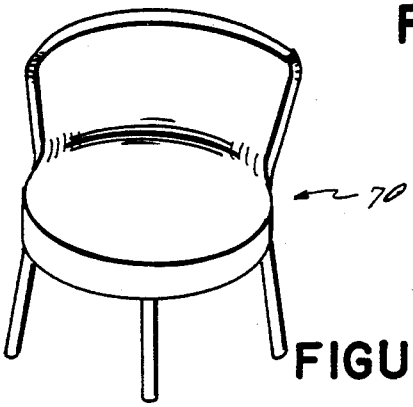
FIG. 7 is a perspective view of a child's chair.

The kitchen play center may additionally include one or more chairs 70 (FIG. 7) which are child size and are adapted for use with the folding table 61.

From the foregoing, it will be seen that the above described kitchen play center device provides an amusing an entertaining toy. The combination of all of the various simulated kitchen components in a single unitary structure is a significant advantage of the instant invention for reasons of assembly, play and storage. A provision of a folding table made integral with the kitchen play center is also considered to be a unique attribute of the present invention.

Yet another significant aspect of the kitchen play center is the use of a design which permits the entire unit to be packaged in a simple manner in as small a volume as possible. This has advantages in both the packaging process itself as well as in the storage of finished units in inventory or in a warehouse, for example. To this end, the folding table 61 when folded fits within the length $L_s$ defined by the stove top. Likewise, the canopy 41 has a longest dimension $L_c$ which is less than or equal to $L_s$. It will thus be seen that the canopy when disassembled from its supports will easily fit within the contours of a box sized to receive the stove 11. For example, with the wall panel structure 44 and support rod 43 appropriately stowed in the stove cavities, the stove 11 is inserted within a box having a horizontal cross section slightly wider than the horizontal cross section of the stove top 12, with the canopy 41 placed flat thereon. The entire kitchen play center is thus simply and compactly packaged in a container of minimized dimensions and volume. Chairs 70 can be separately sold, or provided with the play center through the use of a slightly taller package.

Thus, while the invention has been described in connection with certain presently preferred embodiments, it will be immediately obvious to those skilled in the art that many modifications in structure, arrangement, portions, elements, materials, components may be used in the practice of the invention without departing from the principles of this invention.

What is claimed is:

1. A toy kitchen play center device embodied in a compact unitary structure comprising:

a simulated stove, the stove also serving as a base for the kitchen play center, the stove having a top, bottom and sides, a simulated oven formed in the stove, the oven having an internal cavity and a door for accessing the cavity, a cabinet/simulated refrigerator formed in the stove having an internal cavity and a door for accessing the cavity, the oven cavity and cabinet/simulated refrigerator being located in back-to-back relationship in the stove, the door for accessing the oven and the door for accessing the cabinet/simulated refrigerator opening in opposite directions on opposite sides of said stove, a simulated cooking range, the cooking range located on a portion of the top of the stove, a simulated kitchen sink, the sink located on another portion of the top of the stove, the sink including simulated plumbing fixtures, the simulated range and simulated kitchen sink being located on the stove top in substantially back-to-back relationship, an upright wall panel structure, the wall panel located on yet another portion of the top of the stove, a simulated telephone, the telephone being mounted on the upright wall panel structure, a kitchen canopy and simulated ventilation unit extending over the stove top, the kitchen canopy being carried at one end by the wall panel structure and at the other end by a vertical upright extending from the stove top, a folding table, the folding table being pivotally connected along one side of the stove and pivotable between an upright and open position wherein the table extends substantially perpendicular to the stove side, the table presenting a generally planar upwardly facing table surface in the open position, and a closed position wherein the table extends downwardly and substantially parallel to the stove side, the folding table including a vertically extending support member pivotably connected to the same stove side, the table support in use contacting the underside of the table to thereby support the table in an open and raised position, the table support pivotable between a table support position and a closed and folded position, the support in the closed position being folded against the side of the stove and between the table and the same side.

2. The toy kitchen play center of claim 1 wherein the stove defines an internal space, and which further includes a space divider dividing the space into the oven and cabinet/simulated refrigerator cavities.

3. A toy kitchen play center which is compact in form to facilitate storage and shipping thereof, comprising:

a simulated stove, the stove having a top, bottom and vertically extending sides, the stove defining a generally cube shape, a simulated oven formed in the stove, the oven having an internal cavity and a door for accessing the cavity, a simulated cooking range, the cooking range located on a portion of the top of the stove, a simulated kitchen sink, the sink located on a portion of the top of the stove, the sink including simulated plumbing fixtures, a folding table, the folding table being pivotably connected to one side of the stove and pivotable between an upright and raised position wherein the table extends substantially perpendicular to the stove side and a folded position wherein the table extends downwardly and substantially parallel to the stove side and below the stove top, the folding table including a vertically extending support member pivotally connected to the same stove side, the table support in use contacting the underside of the table to thereby support the table in an upright and raised position, the table support being pivotable between an open and upright position and a closed and folded position, the support in the closed position being folded against the side of the stove and between the table and the same side of the stove, a removable upright wall panel located on a portion of the stove top, the upright wall panel being sized smaller than one of the stove top, stove bottom, vertically extending sides of the stove and oven cavity to facilitate storage of the upright wall panel, a canopy extending over a substantial portion of the stove top, the canopy having a maximum horizontal length less than or equal to the widest horizontal dimension of the stove top, the kitchen play center forming a compact, generally rectangular structure for storage and shipping with the table folded, the upright wall panel removed and stored in juxtaposition to one of the stove top, stove bottom, vertically extending stove sides and oven cavity, and the canopy stored flat on the stove.

4. The toy kitchen play center of claim 3 wherein the upright wall panel is sized to fit within the oven cavity for storage and shipping.

* * * * *